US005470646A

United States Patent [19]

Okamura et al.

[11] Patent Number: 5,470,646

[45] Date of Patent: Nov. 28, 1995

[54] MAGNETIC CORE AND METHOD OF MANUFACTURING CORE

[75] Inventors: Masami Okamura; Takao Sawa; Yoshiyuki Yamauchi; Takao Kusada, all of Kanagawa, Japan

[73] Assignee: Kabushiki Kaisha Toshiba, Kanagawa, Japan

[21] Appl. No.: 221,979

[22] Filed: Apr. 4, 1994

Related U.S. Application Data

[63] Continuation of Ser. No. 897,129, Jun. 11, 1992, abandoned.

[51] Int. Cl.[6] ..... H01F 3/00

[52] U.S. Cl. ..... 428/216; 428/336; 428/458; 428/460; 428/461; 428/692; 428/900; 29/605; 336/213

[58] Field of Search ..... 428/692, 900, 428/336, 480, 458; 29/605; 336/213

[56] References Cited

U.S. PATENT DOCUMENTS

| | | | |
|---|---|---|---|
| 4,871,925 | 10/1989 | Yamauchi et al. | 307/106 |
| 5,069,731 | 12/1991 | Yoshizawa et al. | 148/305 |
| 5,083,366 | 1/1992 | Arakawa et al. | 29/605 |
| 5,091,253 | 2/1992 | Smith et al. | 428/363 |
| 5,242,760 | 9/1993 | Matsuoka et al. | 428/692 |

OTHER PUBLICATIONS

Faltens, A. et al., "Investigation of Metglas toroid fabrication techniques for a heavy ion fusion driver" Journal of Applied Physics 57(1) Apr. 1985.

*Primary Examiner*—Stevan A. Resan
*Attorney, Agent, or Firm*—Finnegan, Henderson, Farabow, Garrett & Dunner

[57] ABSTRACT

A magnetic core comprises a ferroalloy amorphous film and an insulator layer. The preferable ferroalloy amorphous film is defined as follows:

$$(Fe_{1-x}T_x)_{100-y}X_y$$

wherein:
T is at least one element selected from Co and Ni;
X is at least one element selected from Si, B, P, C and Ge; and $0<x\leqq 0.4$ $14\leqq y\leqq 21$ The preferable insulator layer is made of a high polymer film, for example a polyester film. Also, the magnetic core has the magnetic characteristics of the direct current coercive force is 0.2 Oe or less, and total value of residual magnetic flux density and saturated magnetic flux density is 27 KG or more.

32 Claims, 2 Drawing Sheets

MAGNETIC CORE AND METHOD OF MANUFACTURING CORE

This application is a continuation application of Ser. No. 07/897,129 filed Jun. 11, 1992, now abandoned.

BACKGROUND OF THE INVENTION

1. Field of the Invention

This invention relates to a magnetic core and a method of manufacturing the same. More particularly, the invention relates to a high power pulse magnetic core, for example, a saturable magnetic core for use as an electric pulse source for laser or as an induction core for a linear accelerator, and a method of manufacturing the same.

2. Description of the Related Art

A high power pulse magnetic core, such as an induction core for a linear accelerator, applies voltage generated in the secondary gap to accelerate an electron beam through the center of the core.

A magnetic pulse compressor is used in a pulse power source for generating a laser. The pulse compressor can generate high power and operates at high voltage. The pulse compressor compresses a relatively wide pulse generated in the power source to a narrow, high power or spiked pulse and uses the saturation phenomenon of the magnetic core.

Consequently, magnetic cores for these high power pulse devices are made of cobalt alloy amorphous films or ferroalloy amorphous films and polyester films or polyimide films, which are layered alternately. The cobalt alloy amorphous and ferroalloy amorphous films are characterized as having high saturated magnetic flux density, a large squareness ratio of magnetization curve, a low coercive force and a low iron loss. Also, the polyester films and polyimide films have high insulating characteristics.

However, problems are associated with magnetic cores of cobalt alloy amorphous films. One of take problems is that such magnetic core has a low saturated magnetic flux density as compared to magnetic cores of ferroalloy amorphous films. Another problem is the high cost of cobalt alloy materials.

On the other hand, a magnetic core comprising ferroalloy amorphous films and polyester films or polyimide films, the latter being inserted between the amorphous films, has characteristics of high saturated magnetic flux density, and the cost of the ferroalloy materials is low. However, when the polyester films are used as insulators between the amorphous films, the core cannot take heat treatment (about 400° C.) that is needed to make up the magnetic characteristics because the heat resisting temperature of the polyester film is about 200° C. As a result, the magnetic core lacks high magnetic characteristics. As a solution to this problem, before stacking the alloy and polyester films and winding the stacked films into the core, the amorphous alloy films only are heat-treated. But in this way, the magnetic characteristics are deteriorated because of stress acting on the alloy films when they are wound into coil shaped cores with the polyester films.

When the polyimide films are used as insulators, the magnetic core can be heat treated after stacking and winding because the polyimide film has a high heat resistance. However, the polyimide film is very expensive. Also, the polyimide films contract under heat treatment and contribute to stress in the amorphous films which, in turn, may result in deterioration of magnetic characteristics.

In a magnetic core made by the method mentioned above, the direct current coercive force is very high. Therefore, a large number of windings are required for reset or the size of the electric source capacity for reset must be large, especially in the case of high output pulse magnetic core. This is one of the major problems incurred in making the magnetic core industrially. Moreover, the magnetic core made by the method as mentioned above has a low total value of residual magnetic flux density and saturated magnetic flux density, that is, under 24 KG. Therefore, the shape of the magnetic core must be larger in size to obtain the required magnetic characteristics.

Conventionally, the amorphous alloy films are heat-treated between the temperature of 380° C. and the temperature of crystallization. In this condition, structural relaxation is carried out at a rate of progress sufficient to keep the shape of the films. However, when the alloy films are wound alternately with high polymer films, the alloy films are stressed and the magnetic characteristics of the resulting core reduced.

SUMMARY OF THE INVENTION

Accordingly, one of the objects of the present invention is to provide a magnetic core which has characteristics of high saturated magnetic flux density, a large squareness ratio of magnetization curve, a low coercive force, and which can be manufactured industrially at low costs.

Another object of the present invention is to provide a method of manufacturing the magnetic core.

In accordance with the present invention, there is provided a magnetic core which is comprised of a ferroalloy amorphous film including at least one element of Co and Ni and an insulator layer made of a high polymer film. The respective films are stacked alternately and wound into a coil configuration to form the magnetic core. Also, the magnetic core has the magnetic characteristics of 0.2 Oe or less of direct current coercive force and a total value of residual magnetic flux density and saturated magnetic flux density, i.e., the operating magnetic flux density, 27 KG or more.

Also, there is provided a method of manufacturing the magnetic core. The method comprises a step of forming ferroalloy amorphous films including at least one element of Co and Ni by heat-treatment at 360° C. or less and adding a 10 Oe or more magnetic field parallel to the magnetic path of the core. After that, the heat-treated ferroalloy amorphous films are stacked alternately with high polymer films and wound to form the coil shaped magnetic core.

BRIEF DESCRIPTION OF DRAWINGS

These and other objects and advantages of this invention will become more apparent and more readily appreciated from the following detailed description of the presently preferred exemplary embodiments of the invention taken in conjunction with the accompanying drawings wherein.

DESCRIPTION OF THE PREFERRED EMBODIMENTS

Figure 1:
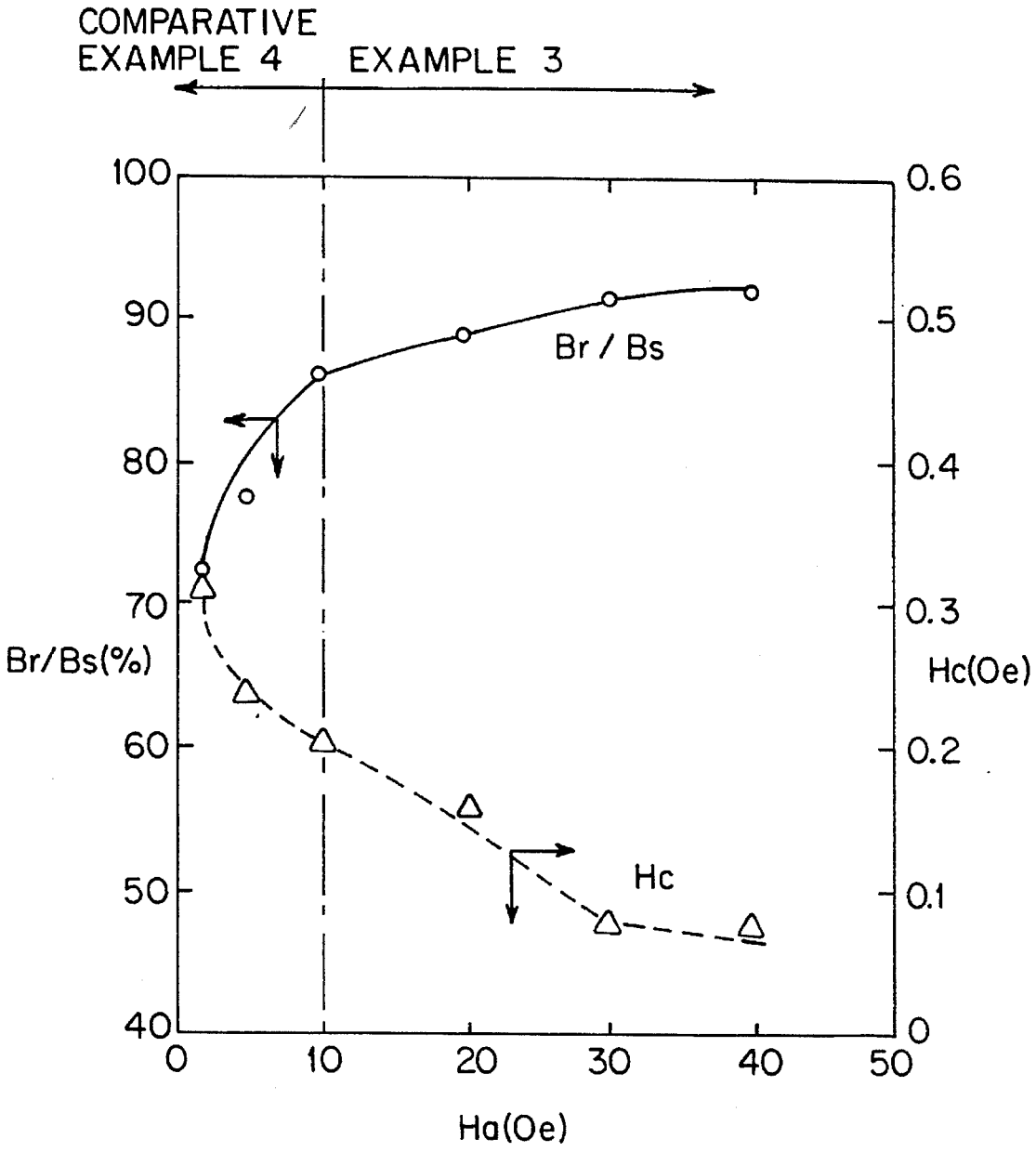
FIG. 1 is a graph showing variation characteristics of the squareness ratio of residual magnetic flux density to saturated magnetic flux density (Br/Bs) and the coercive force (Hc) in relation to variation in the strength of added direct current magnetic field (Ha) having heat treatment; and, FIG. 2 is a graph showing characteristics of the squareness ratio (Br/Bs) to the coercive force (Hc) when the temperature of heat treatment is changing.

In accordance with this invention, a magnetic core is provided in which the direct current coercive force (Hc) is limited to value of 0.2 Oe or less, preferably to 0.15 Oe or less and more preferably to 0.1 Oe or less to reduce the number of the coil windings and the capacity of electric source. When the force (Hc) is 0.1 Oe or less, a special reset circuit, conventionally used with prior art cores, becomes redundant because the charge current to the condenser is used as reset current.

Also, in this invention, the operating magnetic flux density (ΣB), which is the sum of residual magnetic flux density (Br) and the saturated flux density (Bs), is kept to a value of 27 KG or more, preferably 32 KG or more and more preferably 34 KG or more. As a result, the size of magnetic core is reduced. The value (ΣB) is that of only amorphous alloy films.

One of the preferred compositions of ferroalloy amorphous films can be described as follows:

$$(Fe_{1-x}T_x)_{100-y}X_y \qquad (1)\ (\text{atomic } \%)$$

wherein;

T is at least one element selected from Co and Ni;

X is at least one element selected from Si, B, P, C, and Ge;

$0<x\leqq 0.4$; and $14\leqq y\leqq 21$.

Moreover, the elements selected from Ti, Ta, V, Cr, Mn, Cu, Mo, Nb and W are exchanged in the composition of formula (1) under 5% atomic.

The element T, as mentioned above, has the effect of adding induced magnetic anisotropy in heat treatment, reducing the direct current coercive force (Hc) and increasing the squareness ratio (Br/Bs). Co is preferable as the element T because Co has a strong exchange interaction effect to Fe.

When the value of x, i.e. amount of the element T, is over 0.4, the Bs is reduced. Especially when Co is used as T, it is desirable that the value of x is in the range of 0.15 to 0.25, because in this range, the value of saturated magnetic flux density (Bs) is increased.

Element X is added to facilitate formation of the amorphous phase and to obtain thermal stability. A combination of Si and B is preferably used as X. When the value of y is less than 14, it becomes difficult to form the amorphous phase, and when the value of y is over 21, the value of Bs will be reduced. The range of 14 to 17 is desirable.

The ferroalloy amorphous films may be made by any of several conventional methods such as the rapidly quenching method for example.

The thickness of the film can be in a range of 5 μm to 40 μm and preferably, 12 tμm to 26 μm.

In the method of this invention, the ferroalloy amorphous films are heat-treated at a temperature of 360° C. or less to cause slight structural relaxation so that when the alloy films are wound into a core, stress of the alloy film is reduced and reduction of magnetic characteristics is kept to a minimum. Preferably, the heat treatment is carried out at a temperature of 330° C. or less so that the magnetic characteristics are reduced even less.

When the heat treatment is carried out at 360° C. or less, as mentioned above, a slight induced magnetic anisotropy occurs because the atoms in the films are partially diffused. In order to address this phenomenon, the ferroalloy amorphous film according to the invention includes, as a magnetic element, at least one of Co and Ni or both of these metals. Moreover, a strong direct current magnetic field or alternating current magnetic field is applied to the films in parallel to the magnetic path of the core. The strength of the magnetic field is 10 Oe or more, preferably 30 Oe or more, in order to add more magnetic anisotropy and to get larger value of squareness ratio.

When only the amorphous alloy films are heat-treated, i.e., the amorphous alloy films are wound into a coiled configuration without high polymer films, it is desirable to control a space factor to restrain the loss of the magnetic characteristics. The term "space factor" means the ratio of the volume of magnetic materials to whole volume of the wound core. The space factor value of the wound amorphous alloy films should be near to the space factor value of the magnetic core including the amorphous films and high polymer films stacked alternately in the range of ±20%. When the space factor is out of the indicated range, the magnetic characteristics may be reduced excessively.

The polyester film is preferable for high polymer film because it is cheap and stable. Other films, for example a polyamide film, a polyamideimide film, a polysulfone film, a polyetherimide film, a polypropylene film, a polyphenylenesulfide film, a polyetherketone film, a polyethersulfone film, a polyethylene naphthalete film and a polyparabanic acid resin film, also can be used as the insulator film.

The thickness of one polymer film is preferably in the range of about 2 to 50 μm for its insulation ability, the range of about 5 to 30 μm is more preferable.

The number of the stacks of ferroalloy amorphous films and polymer films can be selected depending on the magnetic characteristics required. For example, 2 or more polymer films may be stacked as a single insulator layer, 2 or more amorphous films may be stacked as a single magnetic layer, etc.

EXAMPLES 1, 2 AND COMPARATIVE EXAMPLES 1 to 3

As example 1, a ferroalloy amorphous film, the composition of which is $(Fe_{0.79}Co_{0.21})_{85}Si_1B_{14}$ (atomic %), having an 11 mm width and a 22 μm thickness was prepared by a single roll method. The film was wound to form a core with a space factor of 0.67, an outer diameter of 50 mm, an inner diameter of 30 mm and height of 11 mm.

The 30 Oe direct current magnetic field was applied to the core in parallel to the magnetic path of the core during heat treatment at 320° C. for 2 hours in $N_2$ gas. Then the heat-treated film was rewound alternately with a polyester film of 12 μm in thickness to shape a magnetic core having a space factor of 0.57.

As example 2, a ferroalloy amorphous film, the composition of which is $(Fe_{0.99}Ni_{0.01})_{80}Si_{10}B_{10}$ (atomic %) having a 14 μm thickness was prepared. The film was wound to form a core having a space factor of 0.5. Other factors were as same as example 1. Then the core was heat-treated under the same conditions as example 1 and was rewound with a polyester film the same as example 1 to shape a magnetic core having a space factor of 0.57.

As comparative example 1, a ferroalloy amorphous film, the composition of which is $Fe_{78}Si_9B_{13}$ (atomic %) having an 18 μm thickness was prepared. The film was wound to form a core with a space factor of 0.62. Other factors were the same as example 1. Then the core was heat-treated under the same conditions as example 1 and was rewound with a polyester film the same as example 1 to shape a magnetic core with a space factor of 0.53.

As comparative example 2, a ferroalloy amorphous film, with the composition $Fe_{78}Si_9B_{13}$ (atomic %) 22 μm in thickness was prepared. Then the film was wound to form a core with a space factor of 0.55. Other factors were as same as example 1.

The 30 Oe direct current magnetic field was applied to the core in parallel to the magnetic path of the core during heat treatment at 390° C. for 1 hour. Then the heat-treated film was rewound alternately with a polyester film having a thickness of 13 μm to shape a magnetic core with a space factor of 0.57.

As comparative example 3, a core was formed in the same manner as example 1 except the space factor was 0.63.

Then the 2 Oe direct current magnetic field was applied to the core in parallel to the magnetic path of the core under the same heat treatment conditions as example 1. And the heat-treated film was rewound alternately with a polyester film having a thickness of 12 μm to shape a magnetic core with a space factor of 0.56.

The values of the residual magnetic flux density (Br) and direct current coercive force (Hc) of the core in examples 1, 2 and comparative examples 1 to 3 were measured by a direct current magnetic recorder at application of a 10 Oe magnetic field. The values of the saturated magnetic flux density (Bs) were measured by VSM at the application of the 10 Oe magnetic field.

Using the values as mentioned above, the squareness ratio (Br/Bs) and the total values (ΣB) of residual magnetic flux density (Br) and saturated magnetic flux density (Bs) were also calculated.

The results are given in Table 1.

TABLE 1

| | Hc (Oe) | Br/Bs (%) | Bs (KG) | ΣB (KG) |
|---|---|---|---|---|
| example 1 | 0.08 | 92.1 | 17.9 | 34.4 |
| example 2 | 0.12 | 87.6 | 15.9 | 29.8 |
| comparative example 1 | 0.22 | 58.7 | 15.6 | 24.8 |
| comparative example 2 | 0.25 | 56.6 | 15.6 | 24.4 |
| comparative example 3 | 0.31 | 49.4 | 17.9 | 26.7 |

As shown in Table 1, the magnetic cores of example 1 and example 2 had a low value of direct current coercive force (Hc), which is 0.2 Oe or less, and the total value ΣB (operating magnetic flux density) was 27 KG or more although these cores were heat-treated in the condition of 320° C. or less. Both examples of magnetic cores have higher squareness ratio and better magnetic characteristics than comparative example magnetic cores.

On the other hand, comparative example 1 which does not include either of Co or Ni, comparative example 2 in which heat treatment temperature is over 360° C. and comparative example 3 in which the applied magnetic field was under 10 Oe, had larger forces (Hc), lower squareness ratio (Br/Bs) and lower operating magnetic flux densities (ΣB).

EXAMPLE 3 AND COMPARATIVE EXAMPLE 4

As example 3, several ferroalloy amorphous films having the composition is shown as $(Fe_{0.79}Co_{0.21})_{85}Si_1B_{14}$ (atomic %), 11 mm in width and 22 μm in thickness were prepared by a single roll method. The films were wound individually to form coil shaped cores in which space factors varied from 0.5 to 0.7. The other sizes were as same as example 1 .

Direct current magnetic fields (Ha) in the range of 10 Oe to 40 Oe were applied to the cores in parallel to the magnetic path and heat treated at 320° C. for 2 hours in $N_2$ gas. Then the heat-treated films were rewound alternately with polyester films of 12 μm in thickness to shape magnetic cores having space factors in the range of 0.5 to 0.6.

As a comparative example 4, the same cores as example 3 were also heat-treated in the same condition except that the direct current magnetic field (Ha) was in a range of less than 10 Oe. The magnetic cores for comparative example 4 were formed as similar way as example 3.

Then the values of the squareness ratio (Br/Bs) and coercive force (Hc) of example 3 and comparative example 4 were measured and the results were as shown in FIG. 1.

As shown in FIG. 1, the magnetic cores of example 3 had large squareness ratios (Br/Bs) of about 85% to 92% and low coercive force (Hc) of 0.2 Oe or less. On the other hand, the values of the squareness ratio of comparative example 4 were less than example 3 and the values of the coercive force were larger than example 3.

EXAMPLE 4 AND COMPARATIVE EXAMPLE 5

As example 4, several ferroalloy amorphous films having the composition $(Fe_{0.83}Co_{0.17})_{79}Si_{10.5}B_{10.5}$ (atomic %), 11 mm in width, and 22 μm in thickness were prepared by a single roll method. The films were wound individually to form cores with space factors of from 0.5 to 0.7. The other sizes were as same as example 1.

A 30 Oe direct current magnetic field (Ha) was applied to the cores in parallel to the magnetic path of the core. The heat treatment (Ta) was at temperatures ranging from 290° C. to 360° for 2 hours in $N_2$ gas. Then the heat-treated films were rewound alternately with polyester films 12 μm in thickness to shape magnetic cores with space factors in the range of from 0.5 to 0.6.

As comparative example 5, the same cores as example 4 were also heat-treated in the same magnetic field of example 4 but at a different temperature. The temperature of heat treatment (Ta) was from 370° C. to 400° C. The magnetic cores for comparative example 5 were formed as similar way as example 4.

Figure 2:
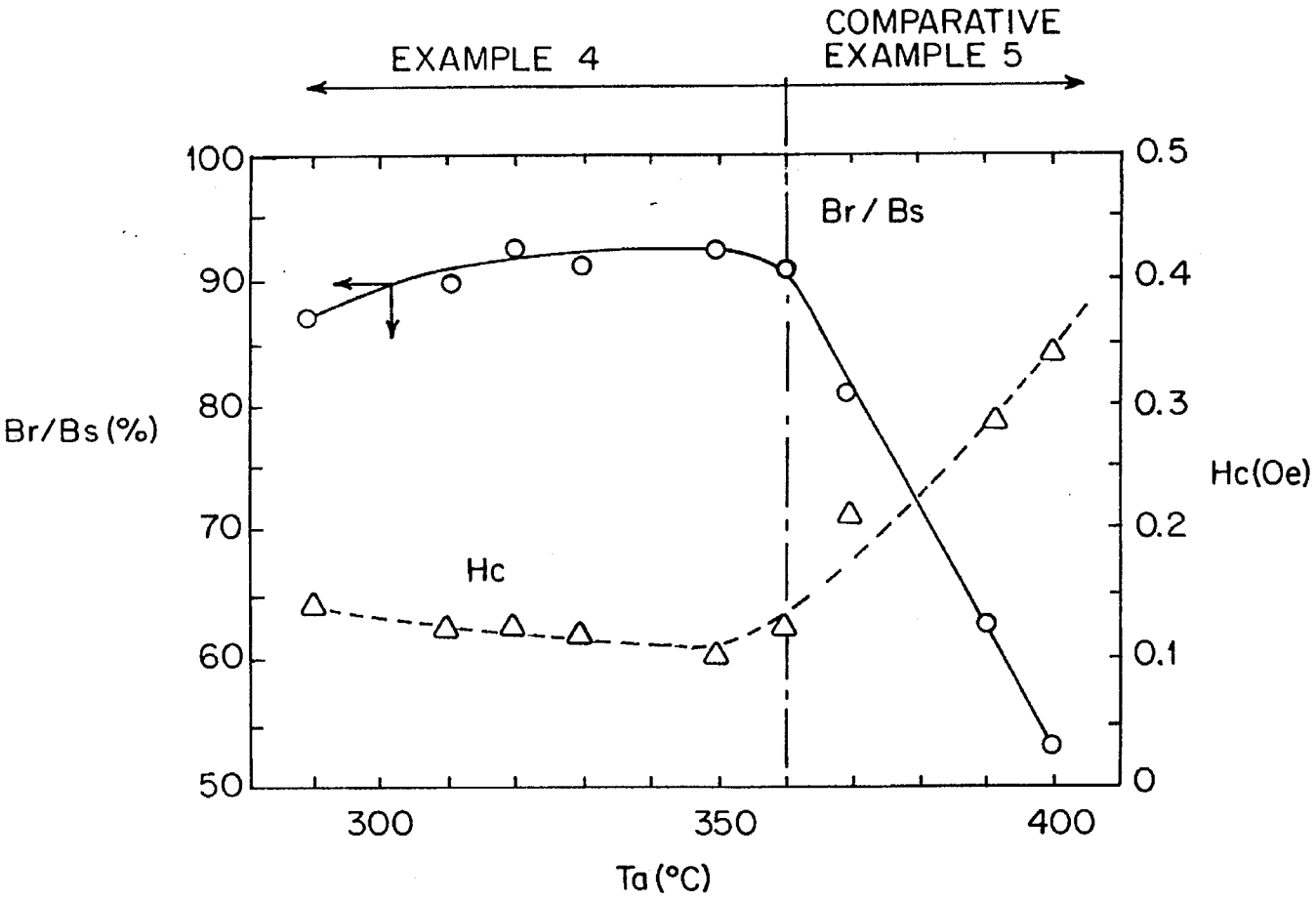

Then the values of the squareness ratios (Br/Bs) and coercive forces (Hc) of example 4 and comparative example 5 were measured and the result was shown in FIG. 2.

As shown in FIG. 2, the magnetic cores of example 4 have large squareness ratio (Br/Bs) and low coercive force (Hc). On the other hand, the values of the squareness ratio of comparative example 5 were less than example 4 and the values of the coercive force were larger than example 4.

EXAMPLE 5

As example 5, three ferroalloy amorphous films having the composition $(Fe_{0.79}Co_{0.21})_{85}Si_1B_{14}$ (atomic %), 50 mm in width and 25 μm in thickness were prepared by a single roll method. The films were wound to form cores with space factors from 0.76 to 0.83, an outer diameter of 320 mm, an inner diameter of 160 mm and a height of 50 mm.

A 30 Oe direct current magnetic field was applied to the cores in parallel to the magnetic path of the core during heat treatment at of 320° C. for 2 hours and in $N_2$ gas. Then the heat-treated films were rewound alternately with polyester films of 6 μm in thickness to shape magnetic cores (#1, #2 and #3) having space factors in the range of 0.65 to 0.75.

The values of the coercive force (Hc), the squareness ratio (Br/Bs), the saturated magnetic flux density (Bs) and the operating magnetic flux (ΣB) are shown in table 2.

TABLE 2

| | Space factor in heat-treated | Space factor in rewound | Hc (Oe) | Br/Bs (%) | Bs (KG) | ΣB (KG) |
|---|---|---|---|---|---|---|
| #1 | 0.83 | 0.75 | 0.023 | 98.7 | 17.9 | 35.6 |
| #2 | 0.76 | 0.65 | 0.040 | 95.6 | 17.9 | 35.0 |
| #3 | 0.80 | 0.73 | 0.021 | 97.0 | 17.9 | 35.3 |

These magnetic cores according to the invention also have good magnetic characteristics as shown in table 2.

The present invention has been described with respect to specific embodiments. However, other embodiments based on the principles of the present invention should be obvious to those of ordinary skill in the art. Such embodiments are intended to be covered by the claims.

We claim:

1. A magnetic core comprising, a wound ferroalloy amorphous film defined by $$(Fe_{1-x}T_x)_{100-y}X_y$$

wherein

T is at least one element selected from Co and Ni

X is at least one element selected from Si, B, P, C and Ge $0<x\leqq 0.4$ $14\leqq y\leqq 21$; and a polymer insulating film wound with the ferroalloy amorphous film;

wherein the value of the direct current coercive force of the magnetic core is 0.2 Oe or less, and the total value of residual magnetic flux density and saturated magnetic flux density is 27 KG or more.

2. The magnetic core of claim 1, wherein the value of the direct current coercive force is 0.1 Oe or less.

3. The magnetic core of claim 2, wherein the value of the direct current coercive force is 0.06 Oe or less.

4. The magnetic core of claim 1, wherein the total value of residual magnetic flux density and saturated magnetic flux density is 32 KG or more.

5. The magnetic core of claim 4, wherein the total value of residual magnetic flux density and saturated magnetic flux density is 34 KG or more.

6. The magnetic core of claim 1, wherein the polymer insulating film is a polyester film.

7. The magnetic core of claim 1, wherein the polymer film is at least one of a polyester film, a polyamide film, a polyamideimide film, a polysulfone film, a polyetherimide film, a polypropylene film, a polyphenylenesulfide film, a polyetherketone film, a polyethersulfone film, a polyethylene naphthalete film and a polyparabanic acid resin film.

8. The magnetic core of claim 1, wherein the polymer film is a material selected from the group consisting of polyester, polyamide, polyamideimide, polysulfone, polyetherimide, polypropylene, polyphenylenesulfide, polyetherketone, polyethersulfone, polyethylene naphthalete and polyparabanic acid resin.

9. The magnetic core of claim 1, wherein the thickness of the ferroalloy amorphous film is in a range of 5 μm to 40 μm.

10. The magnetic core of claim 9, wherein the thickness of the ferroalloy amorphous film is in a range of 12 μm to 26 μm.

11. The magnetic core of claim 6, wherein the thickness of the polymer film is in a range of 2 μm to 50 μm.

12. The magnetic core of claim 11, wherein the thickness of the polymer film is in a range of 5 μm to 30 μm.

13. A magnetic core comprising, a wound ferroalloy amorphous film defined by $$(Fe_{1-x-p}T_xZ_p)_{100-y}X_y$$

wherein

T is at least one element selected from Co and Ni

X is at least one element selected from Si, B, P, C and Ge

Z is at least one element selected from Ti, Ta, V, Cr, Mn, Cu, Mo, Nb and W $0<x\leqq 0.4$ $14\leqq y\leqq 21$;

$0<p\leqq 5$; and a polymer insulating film wound with the ferroalloy amorphous film;

wherein the value of the direct current coercive force of the magnetic core is 0.2Oe or less, and the total value of residual magnetic flux density and saturated magnetic flux density is 27 KG or more.

14. The magnetic core of claim 13, wherein the value of the direct current coercive force is 0.1 Oe or less.

15. The magnetic core of claim 14, wherein the value of the direct current coercive force is 0.06 Oe or less.

16. The magnetic core of claim 13, wherein the total value of residual magnetic flux density and saturated magnetic flux density is 32 KG or more.

17. The magnetic core of claim 16, wherein the total value of residual magnetic flux density and saturated magnetic flux density is 34 KG or more.

18. The magnetic core of claim 13, wherein the polymer insulating film is a polyester film.

19. The magnetic core of claim 13, wherein the polymer film is at least one of a polyester film, a polyamide film, a polyamideimide film, a polysulfone film, a polyetherimide film, a polypropylene film, a polyphenylenesulfide film, a polyetherketone film, a polyethersulfone film, a polyethylene naphthalete film and a polyparabanic acid resin film.

20. The magnetic core of claim 13, wherein the polymer film is a material selected from the group consisting of polyester, polyamide, polyamideimide, polysulfone, polyetherimide, polypropylene, polyphenylenesulfide, polyetherketone, polyethersulfone, polyethylene naphthalete and polyparabanic acid resin.

21. The magnetic core of claim 13, wherein the thickness of the ferroalloy amorphous film is in a range of 5 μm to 40 μm.

22. The magnetic core of claim 21, wherein the thickness of the ferroalloy amorphous film is in a range of 12 μm to 26 μm.

23. The magnetic core of claim 13, wherein the thickness of the polymer film is in a range of 2 μm to 50 μm.

24. The magnetic core of claim 23, wherein the thickness of the polymer film is in a range of 5 μm to 30 μm.

25. The method of manufacturing a magnetic core comprising the steps of:

winding a ferroalloy amorphous film including at least one of Co and Ni to form a ferroalloy amorphous film core having a first space factor defined by the ratio of ferroalloy amorphous film volume to ferroalloy amorphous film core volume, heat treating the ferroalloy amorphous film core at temperatures of 360° C. or less while maintaining said first space factor and subjecting the ferroalloy amorphous film core to a magnetic field of 10 Oe or more in parallel to the magnetic path of the magnetic core, and rewinding the ferroalloy amorphous film core with an insulating layer to form the magnetic core with a second space factor defined by the ratio of ferroalloy amorphous film volume to the volume of the magnetic core, said first space factor being in a range of 80% to 120% of the second space factor.

26. The method of claim 25, wherein the insulating layer is a high polymer film.

27. The method of claim 26 wherein the polymer film is polyester film.

28. The method of claim 26, wherein the polymer film is at least one of a polyester film, a polyamide film, a polyamideimide film, a polysulfone film, a polyetherimide film, a polypropylene film, a polyphenylenesulfide film, a polyetherketone film, a polyethersulfone film, a polyethylene naphthalete film and a polyparabanic acid resin film.

29. The method of claim 26, wherein the polymer film is a material selected from the group consisting of polyester, polyamide, polyamideimide, polysulfone, polyetherimide, polypropylene, polyphenylenesulfide, polyetherketone, polyethersulfone, polyethylene naphthalete and polyparabanic acid resin.

30. The method of claim 25 wherein said heat treating step is conducted at 330° C. or less.

31. A magnetic core product formed by the method of claim 25 wherein the ferroalloy amorphous film is defined by $$(Fe_{1-x}T_x)_{100-y}X_y$$

wherein

T is the at least one element selected from Co and Ni

X is at least one element selected from Si, B, P, C and Ge $0<x\leqq 0.4$ $14\leqq y\leqq 21$; and wherein the value of the direct current coercive force of the magnetic core is 0.2 Oe or less, and the total value of residual magnetic flux density and saturated magnetic flux density is 27 KG or more.

32. A magnetic core product formed by the method of claim wherein the ferroalloy amorphous film is defined by $$(Fe_{1-x-p}T_xZ_p)_{100-y}X_y$$

wherein

T is at least one element selected from Co and Ni

X is at least one element selected from Si, B, P, C and Ge

Z is at least one element selected from Ti, Ta, V, Cr, Mn, Cu, Mo, Nb and W $0<x\leqq 0.4$ $14\leqq y\leqq 21$;

$0<p\leqq 5$; and an insulating layer wound with the ferroalloy amorphous film;

wherein the value of the direct current coercive force of the magnetic core is 0.2 Oe or less, and the total value of residual magnetic flux density and saturated magnetic flux density is 27 KG or more.

* * * * *

UNITED STATES PATENT AND TRADEMARK OFFICE

CERTIFICATE OF CORRECTION

PATENT NO. : 5,470,646

DATED : November 28, 1995

INVENTOR(S) : Masami OKAMURA et al.

It is certified that error appears in the above-indentified patent and that said Letters Patent is hereby corrected as shown below: On the title page: Item [75] line 2, "Kusada" should read as --Kusaka--.

On the title page: Item [54] and Column 1, line 2, In the Title, line 2, after "MANUFACTURING", insert --A MAGNETIC--.

Claim 13, column 8, line 24, "0.20e" should read --0.2 0e--.

Claim 32, column 10, line 15, "claim" should read --claim 25--.

Signed and Sealed this

Seventh Day of January, 1997

*Attest:*

*Attesting Officer*

BRUCE LEHMAN

*Commissioner of Patents and Trademarks*